United States Patent [19]

Greene et al.

[11] 4,378,110

[45] Mar. 29, 1983

[54] CONTINUOUS PAPER SORTING MACHINE

[76] Inventors: Ronald W. Greene, 3116 S. 133rd St., Seattle, Wash. 98168; David H. Holliday, 15521 15th St., NE., Seattle, Wash. 98155; Anthony C. Clarkson, Turk Hill Rd., Brewster, N.Y. 10509

[21] Appl. No.: 198,354

[22] Filed: Oct. 20, 1980

Related U.S. Application Data

[63] Continuation of Ser. No. 897,272, Apr. 17, 1978, abandoned.

[51] Int. Cl.[3] ..... B65H 39/11

[52] U.S. Cl. ..... 271/292; 271/294; 271/297; 271/305

[58] Field of Search ..... 271/292, 294, 297, 287, 271/288, 296, 305, 279; 270/58; 209/657, 935

[56] References Cited

U.S. PATENT DOCUMENTS

| | | | |
|---|---|---|---|
| 3,516,654 | 6/1970 | Mestre | 271/292 |
| 3,774,906 | 11/1973 | Fagan et al. | 271/297 X |
| 3,866,904 | 2/1975 | Stemmle | 271/294 X |
| 3,913,905 | 10/1975 | Schulze | 271/292 |
| 3,938,801 | 2/1976 | Holliday | 271/292 |
| 3,944,217 | 3/1976 | Greene et al. | 271/297 X |
| 4,006,894 | 2/1977 | Raible et al. | 271/296 |

*Primary Examiner*—Bruce H. Stoner, Jr.
*Attorney, Agent, or Firm*—Cole, Jensen & Puntigam

[57] ABSTRACT

Continuous paper sorter mechanism in which a receiver section is comprised of at least two columns of inclined side-by-side stacks of paper storage bins or shelves with entrances for receiving paper sheets from the feeder. The receiver is mounted for lateral movement relative to a feeder mechanism, such that the bin entrances move past the feeder in a generally vertical plane. The feeder has an in-feed conveyor which takes paper from a copy making device such as a press or duplicating machine and feeds the sheets of paper either to an intermediate downwardly inclined conveyor or onto an intermediate upwardly inclined conveyor, depending on whether the feeder is distributing paper sheets from the top or from the bottom. Sheets from the intermediate conveyors in turn are transported to a generally vertically disposed, reversible feeder conveyor. The feeder conveyor is provided with a plurality of two-way deflectors which intercept the paper sheets and direct them off the conveyor moving either downwardly or upwardly. A deflector guide section is disposed between the deflectors and the entrances of the bins in the receiver. A proof tray mechanism is also provided over the in-feed conveyor.

21 Claims, 21 Drawing Figures

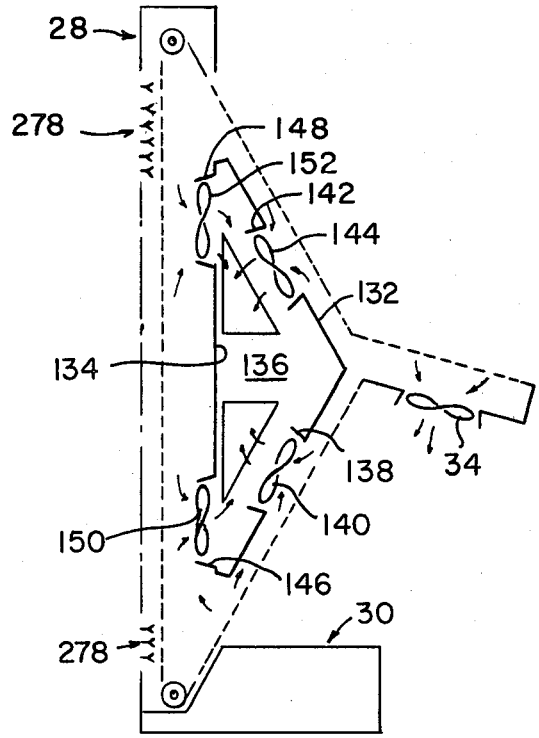
FIG. 5
FIG. 7
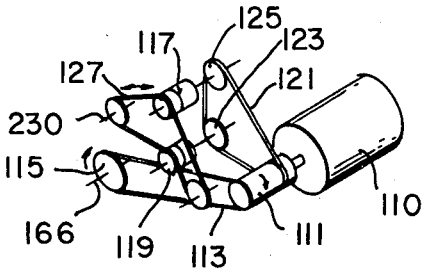
FIG. 6
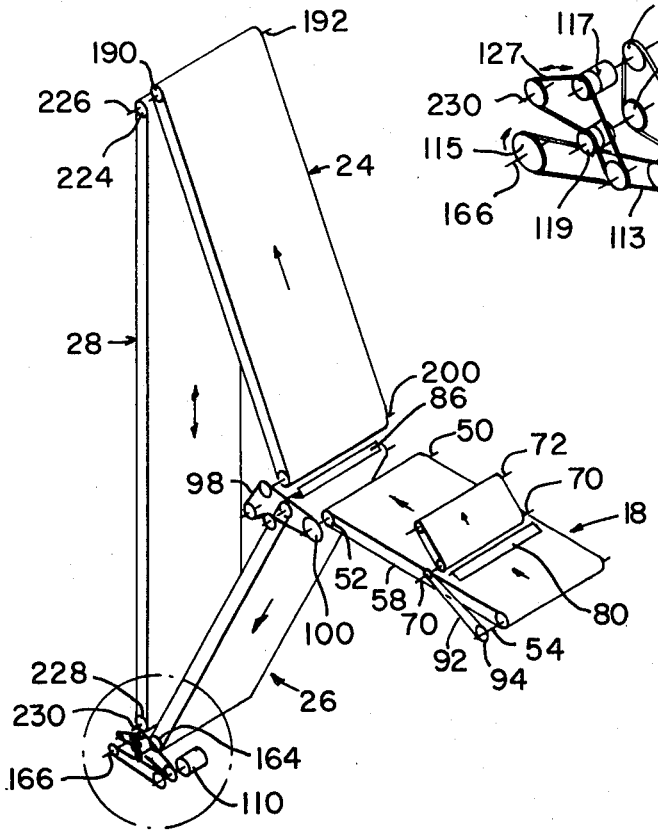

FIG. 19
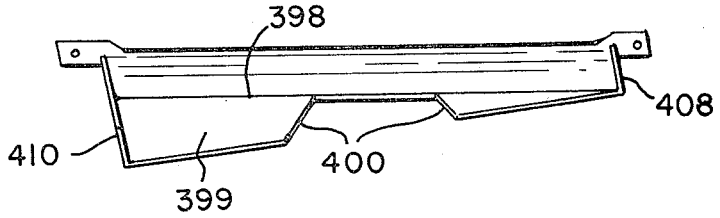
FIG. 20
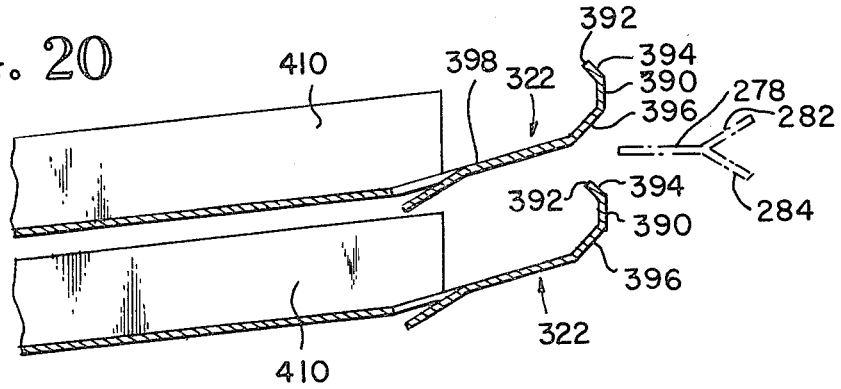
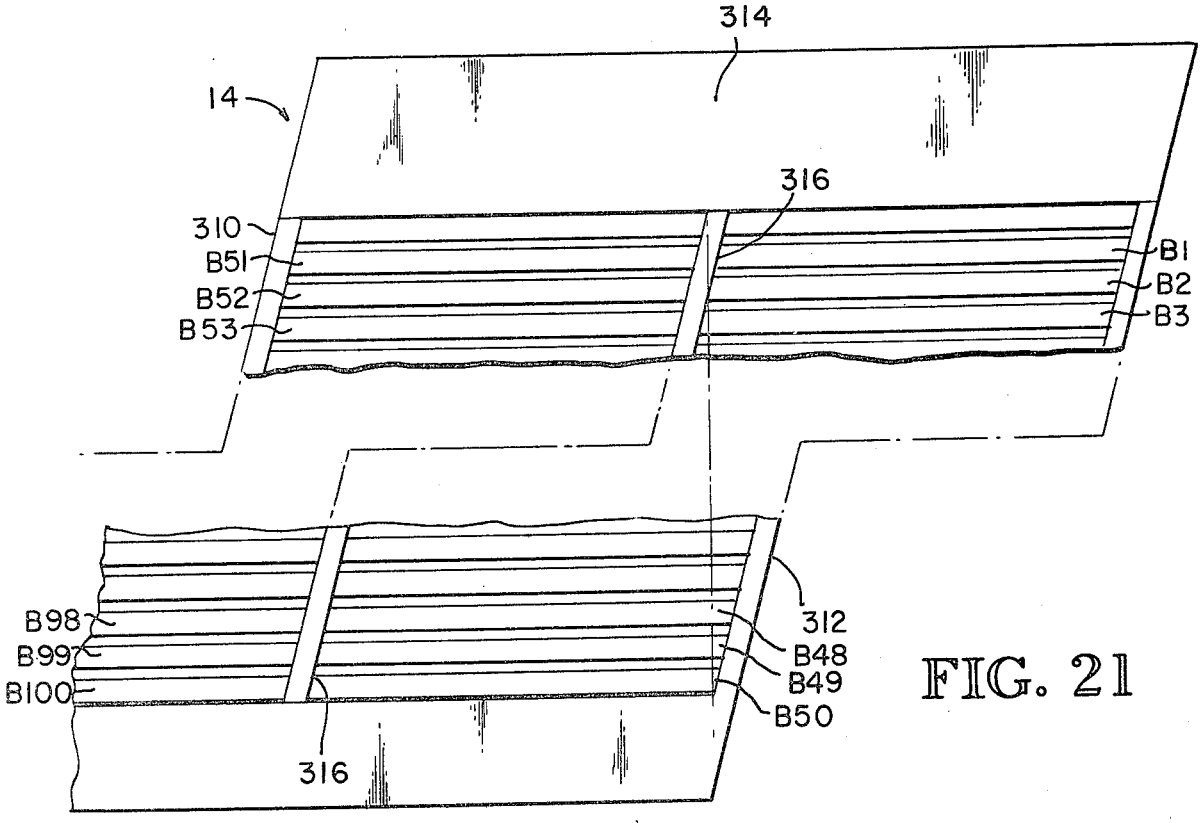
FIG. 21

CONTINUOUS PAPER SORTING MACHINE

This is a continuation of application Ser. No. 897,272, filed Apr. 17, 1978, now abandoned, for CONTINUOUS PAPER SORTING MACHINE.

BACKGROUND OF THE INVENTION

This invention relates to sheet distributing or sorting devices and more particularly to an apparatus which can continuously sort large numbers of multipaged documents as copies of a particular page proceed from a reproducing device such as a printer or copy making machine. This application references copending applications Ser. No. 897,274, for "Feeding Mechanism For A Continuous Sorting Machine"; Ser. No. 897,273, for "Bin Receiver Mechanism for a Continuous Paper Sorting Machine"; and Ser. No. 897,275, for "Paper Sheet Deflecting System for Sorter Mechanism" all of which were filed on Apr. 17, 1978, and are now abandoned.

Prior art paper distributors, sorters and/or collators have encountered many problems. One is that the increases in material and labor costs have made it imperative that the capacity of the reproduction machine be utilized to its maximum. In order for the maximum production capability of a printing or copy making machine to be utilized, it is necessary that the sorter have the capacity to receive the printer or copy making machine output without undue loss of press or copy making machine time. Large volume sorting machines have been introduced to the market place but they are not continuous. For instance, after a column of trays or bins has been filled, it is necessary to shift that filled column away from the feeder and move an empty column into position to continue the sorting job. Thus, there is lost a significant amount of press or copy machine production time between columns. Additionally, time is lost if the bins have to be unloaded on line.

The differences in the volume of jobs that sorters must handle suggest that sorters should be modular to the extent that if a module does not have the capacity, additional modular receiver bin sections may be provided without any substantial loss of time or extra handling of the copied material. While smaller collators or sorters are mainly intended for the office market as a necessary adjunct to office copying machinery, larger sorters are more intended for the high production commercial market and for large in-plant reproduction centers, commercial houses and printing departments. These higher volume paper handling installations may be turning out catalogs, maintenance manuals, instruction books, brochures, sales material and perhaps other items such as reports, bid specifications and other large quantity multi-page publications. Those skilled in the art will appreciate the savings in labor, time and money if the output of a printing or copying center can be sorted and handled at a rate which is matched to the press and duplicating machinery production capability.

Among the prior art references which may be considered with respect to the features of this invention are the following: U.S. Pat. Nos. 3,420,517; 3,273,882; 3,356,362; 3,848,867; 3,937,459; 3,938,801; 3,740,050; 3,944,217; and 3,963,235. The devices covered by the above list of patents are considered to be non-anticipatory of the teachings of this invention.

SUMMARY OF THE INVENTION

A continuous paper sorting machine in which the receiver with the bins is designed generally in accordance with the teachings of U.S. Pat. No. 3,938,801 which describes side-by-side stacks of inclined columns of paper receiving bins or shelves. The receiver of this invention is moved laterally with respect to a generally upright feeding device, in which the feeder is comprised of a base section and an upstanding tower portion. An in-feed conveyor is located generally midway between the top and bottom of the tower and receives sheets of paper from the press or duplicating machinery. A proof tray is supported above the infeed conveyor and a deflector mechanism is provided on the infeed conveyor for directing the sheets either upwardly into the proof tray or to allow the sheets to pass on through to the feeder. At the inner end of the infeed conveyor are an upwardly extending intermediate conveyor and a downwardly extending intermediate conveyor. A deflector at the junction of the infeed and the upward and downwardly intermediate conveyors directs sheets of paper either into the upper intermediate conveyor or onto the downwardly intermediate conveyor depending upon feeder controls programming. A generally vertically disposed reversible feeder conveyor extends between the outer ends of the two intermediate conveyors and receives paper from either direction. The feeder has drive and clutching means for reversing the direction of movement of the feeder conveyor. A series of paper deflectors are located on the feed conveyor and are designed to deflect paper copies from either direction. The deflectors are individually actuated by drive solenoids. A deflector guide section is provided on a hinged frame which swings away from the conveyor to allow access to paper jams and for maintenance. The deflector guide frame is mounted for pivotal movement so that the guides are precisely located with respect to the entrances to the bins on the receiver.

The receiver is constructed in two column modules which moves on casters along a track assembly. A chain drive mechanism has means for being releasably engaged by a fork on the receiver base. The chain is precisely controlled to present a particular bin address to a deflector at a given instant in time. Several modular receivers may be detachably engaged to each other so that as many as 600 bin addresses may be utilized. The bins are generally horizontal at their entrance end but tilt or slant to one side in order to aid the alignment of paper sheets into neat stacks as the sheets are fed into the bin.

Accordingly, it is among the features, objects and advantages of the invention to provide a paper sorting machine feeder device which is continuous and uniquely designed and intended for maximizing the production of a commercial printing, reproducing, duplicating or copying center. The invention is particularly intended to reduce and to minimize the amount of time a reproduction, printing or copying device loses due to the lack of a continuous paper copy sorting capability which is matched to copy making capacity. Because of the unique feeder in conjunction with the canted columns of bins type of receiver, there is no necessity to stop the sorting of paper copies from column to column. The machine can continue to sort as it moves from column to column without interruption of copy production. The receiver can be unloaded off line, so that a filled receiver may be rolled away and an empty receiver moved into position with a minimum of lost time. The invention is particularly suited for use in printing shops or reproduction centers for such things as multi-page brochures, catalogs, books and other items which must be produced in large numbers. The machine is capable of receiving sheets and feeding them at the high speeds of present day advanced copying, printing and duplicating machinery.

BRIEF DESCRIPTION OF DRAWINGS

FIG. 5 is a diagrammatic view of the conveyor drives and clutching arrangements for reversing the feeder conveyor;

FIGS. 6 and 7 are schematic representations of the conveyors and their belt drives;

FIG. 19 is an end elevational view of the bin of FIG. 18;

FIG. 20 is a partial elevation cross-section of a bin and particularly of its entrance end with respect to deflector guides on its feeder; and FIG. 21 is a partial front diagrammatic view of the receiver to further illustrate details of construction.

DESCRIPTION OF PREFERRED EMBODIMENT

Figure 1:
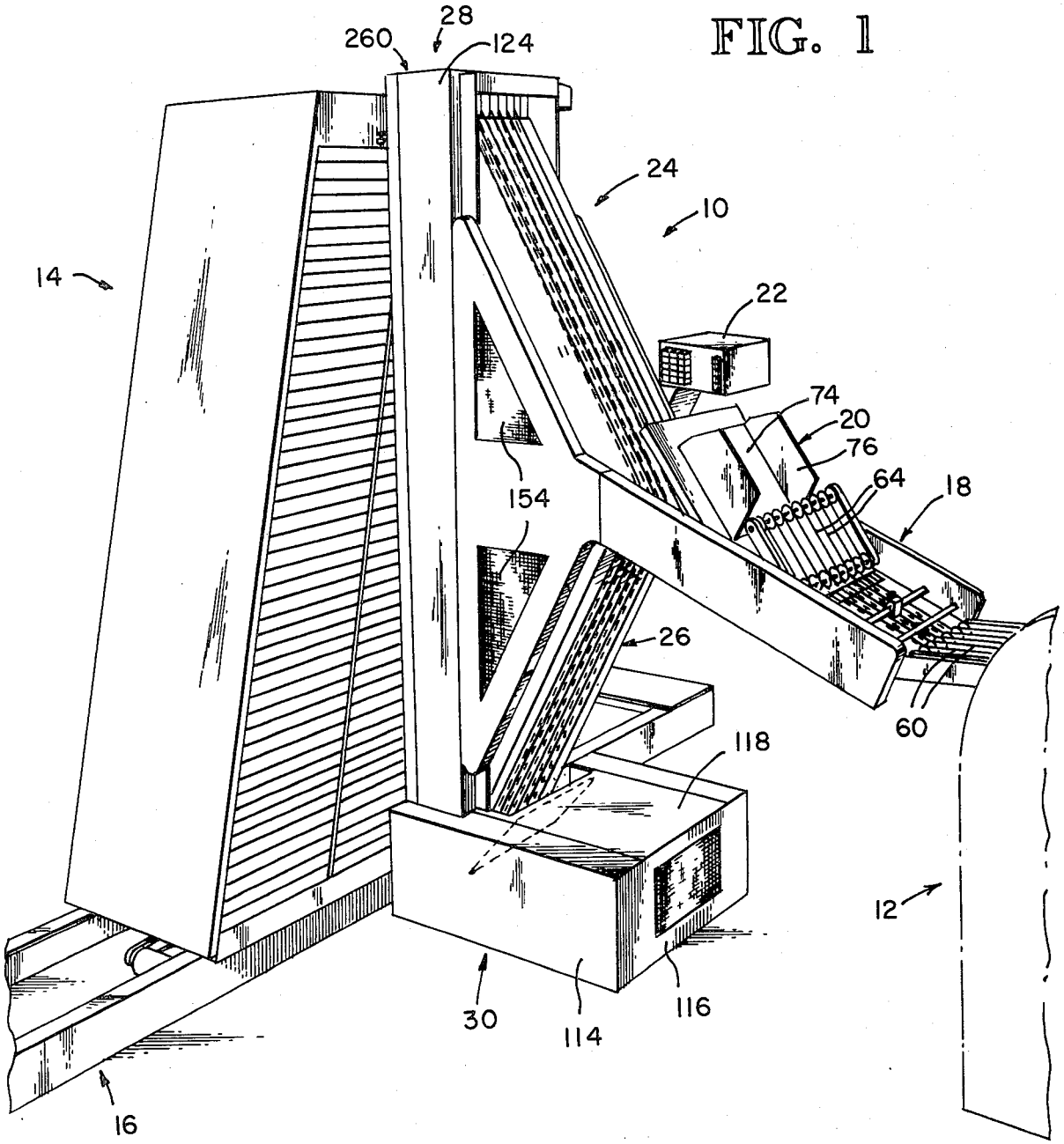
FIG. 1 is a perspective view showing the general arrangement and organization of the sorter and particularly of the feeder mechanism of this invention.

Referring now to the drawings and particularly FIG. 1, it will be seen that the feeder mechanism of this invention, generally designated by the number 10, is in position between a duplicator or press device generably designated by the number 12 and a receiver mechanism generally designated by the number 14. The receiver means laterally on track structure 16. Feeder 10 includes infeed conveyor section 18, a proof tray assembly 20 and a control panel 22. The infeed conveyor feeds either to an upwardly angled intermediate conveyor 24 or a downwardly angled intermediate conveyor 26. A tower section generally designated by the number 28 supports a vertically disposed reversible feeder conveyor, bin deflectors and guides to be described more in detail hereinafter. The tower section 28 is supported on a base section 30 shown in generally outlined form in FIG. 1.

Figure 2:
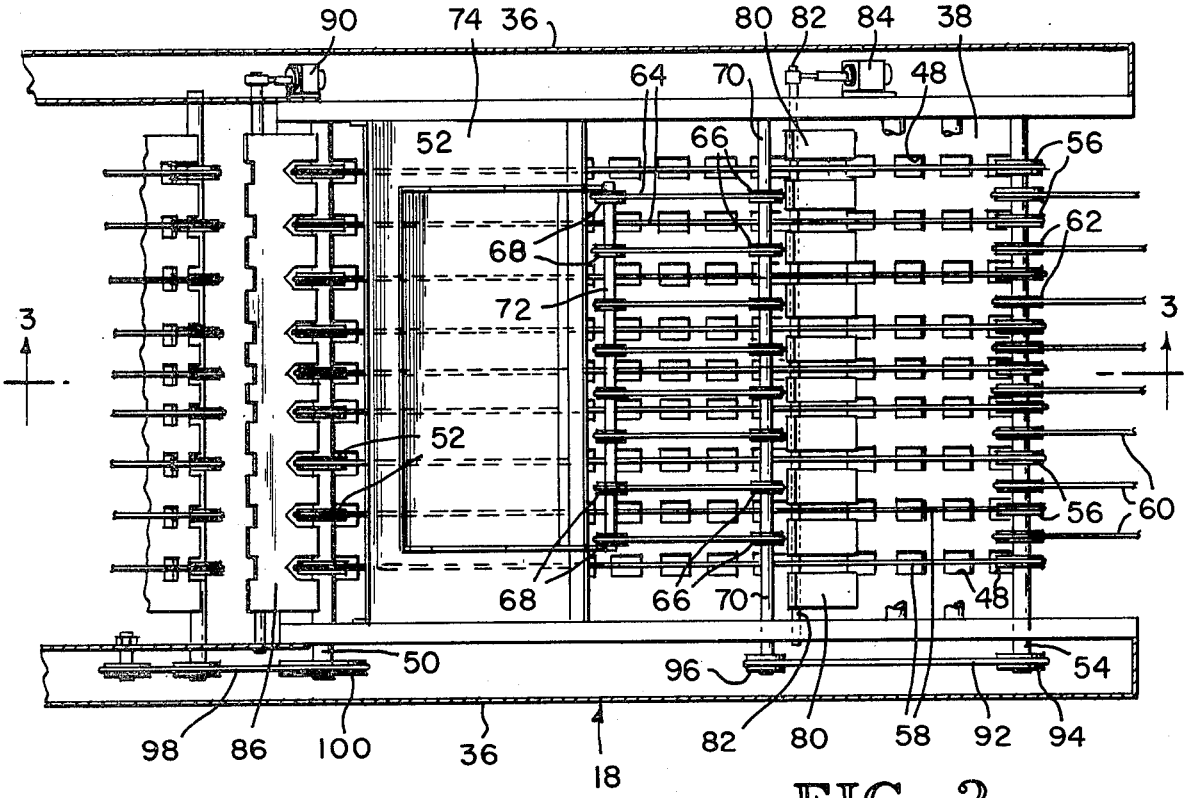
FIG. 2 is a partial top plan view of the infeed conveyor including the proof tray.
Figure 3:
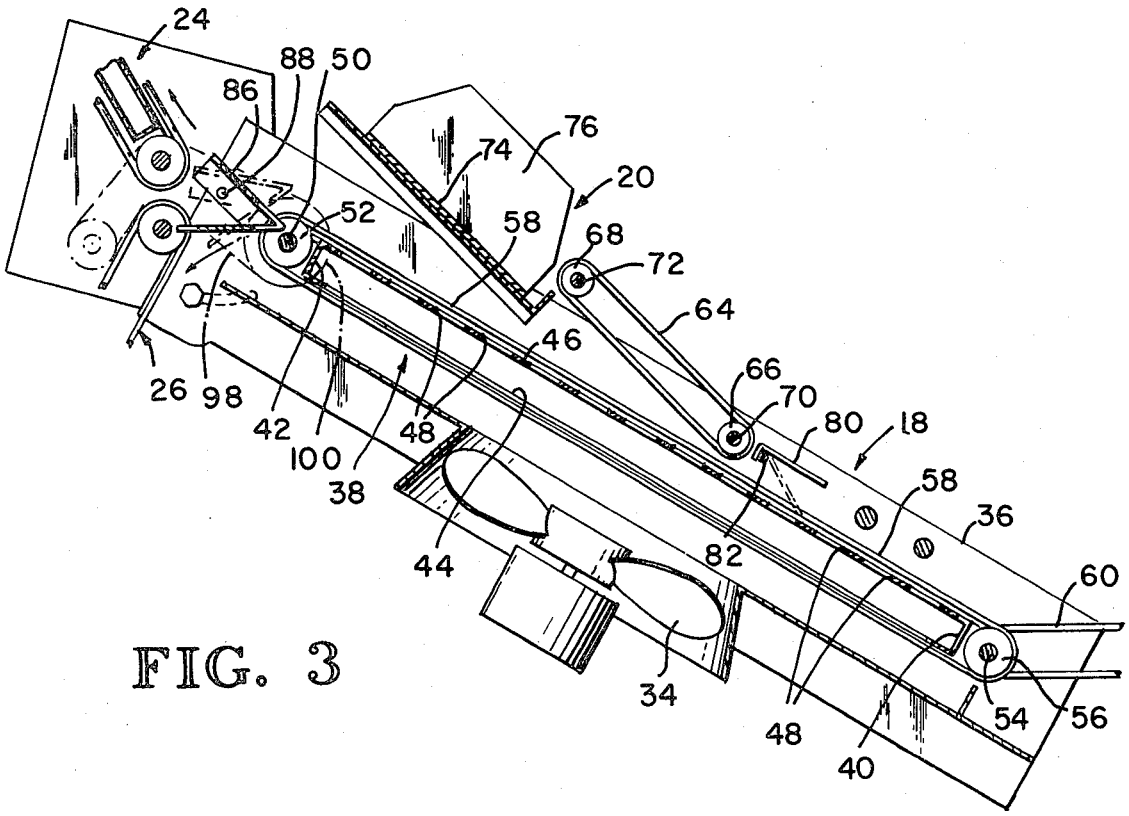
FIG. 3 is a partial side elevation view in cross-section showing details of the infeed conveyor and details of its construction.

Referring now to FIGS. 2 and 3, it will be seen that the infeed conveyor 18 includes side frame members 36 in which is supported a conveyor plenum enclosure 38 having an outer end 40 and inner end 42. The conveyor plenum 38 has a wall 46 in which are disposed rows of openings 48. The openings 48 are formed in the wall 46 so as to present transverse as well as longitudinal rows over substantially the entire length of the plenum structure 38. A shaft 50 is supported adjacent the inner end 42 of the plenum and has affixed thereto a plurality of rollers 52. In like manner, at the outer end 40 a shaft 54 has a series of belt rollers 56. A series of belts 58 extend around the rollers 52 and 56 as seen in the drawings. A short section of transfer conveyor belts 60 extend around rollers 62 which are also affixed to shaft 54 to accept the sheets of paper from the press or duplicating device for transfer to the infeed conveyor 18. A fan means 34 is provided in the infeed conveyor for creating vacuum or negative pressure for holding the sheets of paper on the belts 58.

The proof tray structure, generally designated by the number 20 includes proof conveyor belts 64 which extend around pulleys 66 and 68 mounted on shafts 70 and 72 respectively. The proof conveyor feeds to a tray 74 having side walls 76. A proof deflector 80 is mounted on a shaft 82 and is biased into a normal position such that when power is off the deflector would be in an intercept position with respect to sheets of papers coming onto the infeed conveyor. The proof deflector 80 is actuated by a solenoid 84 as seen in FIG. 2. Additionally, a direction deflector 86 is provided at the inner end of the infeed conveyor structure for directing sheets of paper off the infeed conveyor either to the upwardly angled intermediate conveyor 24 or the downwardly angled intermediate conveyor 26. Directional deflector 86 is mounted on shaft 88 and is in turn selectively actuated by the solenoid 90 again shown in FIG. 2. The proof conveyor belts and pulleys 64, 66 and 68 are driven by a power belt 92 extending from a drive pulley 94 on shaft 54 to a pulley 96 mounted on shaft 70. The infeed conveyor belts 58 in turn are driven by a belt 98 which extends around drive pulley 100 mounted on shaft 50, again as best seen in FIGS. 2 and 3.

Figure 4:
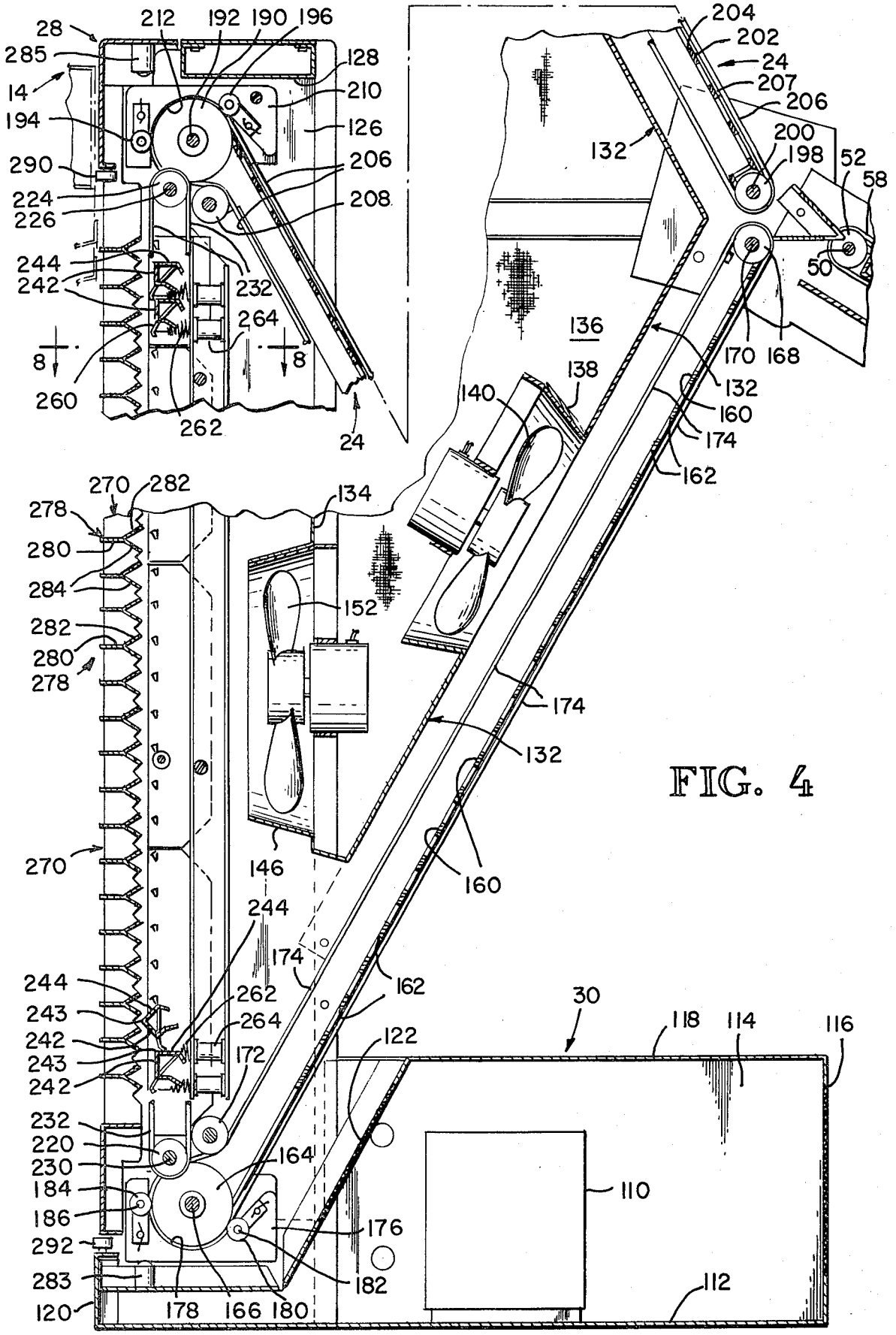
FIG. 4 is a partial elevational cross-section view of the machine showing additional details of the intermediate conveyors and of the infeed conveyor section.
Figure 8:
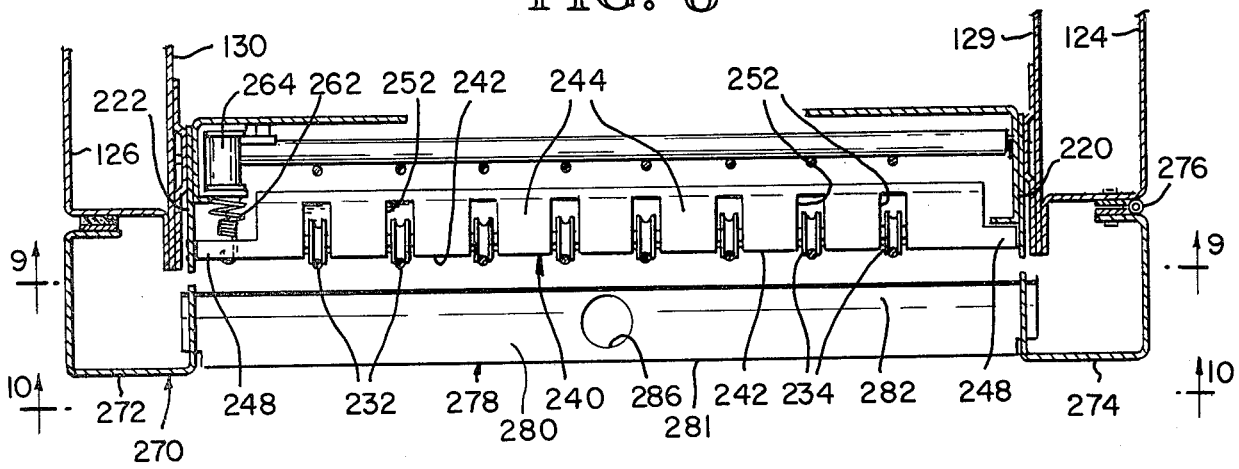
FIG. 8 is a partial cross-section view along the line 8—8 of FIG. 4 showing additional details of the feeder conveyor construction.

FIG. 4, directed to details of the base 30 and the feeder tower frame 28, shows base 30 to be a generally rectangular box-like structure housing motor 110 and other parts as will be more particularly described hereinafter. Base 30 has a bottom wall 112, side walls 114, a rear wall 116 and top wall 118. A conveyor frame receiving area is defined by a recessed wall 120 which is spaced a predetermined distance from the front wall 120, and as can be seen, angles upwardly and rearwardly generally parallel to the bottom intermediate conveyor section 26. Supported within the recessed area of the frame are two spaced apart main upstanding or vertical frame members 124 and 126 seen in FIG. 4 and also in FIG. 8. A horizontal top frame member 128 interconnects main upright frame members 124 and 126. Mounting frame members 129 and 130, as best seen in FIG. 8, are secured to the main upright frame members 124 and 126, respectively, for additional frame rigidity as well as for supporting other parts.

Supported between the uprights 124 and 126 is an internal, triangular, inner wall structure generally designated by the number 132. It will be seen by reference to FIG. 4 that the wall 132 extends from near the lower end of the uprights to a point near the upper end of the uprights. Extending generally vertically is a wall 134 which with wall 132 defines a triangular enclosed space 136 within a basic frame structure. A shroud occupied by the fan 140 provides air evacuation means for the lower intermediate conveyor 26 while a fan 144 surrounded by shroud 142 provides air evacuation means for the upper intermediate conveyor 24. Note that the shrouds and fans 138, 140, 142 and 144 are part of the wall structure 132 just described. In the vertical wall 134 are shroud 146 towards the lower part of cavity 136 and shroud 148 towards the upper part of cavity 136. In this regard, see also FIG. 5. Shrouds 146 and 148 are occupied by fans 150 and 152, respectively. The air evacuation means direct the air inwardly from the direction of the conveyors and exhaust it through screened openings 154 as shown in FIG. 1.

Lower intermediate conveyor 26 includes an elongated generally rectangular plenum wall 160 which has both transverse and longitudinal series of holes 162. At the lower end of the plenum are a series of belt conveyor pulleys 164 mounted on shaft 166. At the upper end of lower intermediate conveyor 26 are a plurality of belt pulleys 168 mounted on shaft 170. Since the sheets of paper must transverse around the lower end of intermediate conveyor 26, the radius of turn is larger as can be seen by reference to the relative difference between the lower pulleys 164 as opposed to the upper pulleys 168. A series of guide and idler pulleys 172 increase the amount of wrap of the belts 174 around rollers 164 but are primarily for the purpose of keeping the belts out of the way of other parts. A series of spaced apart guide plates 176 having a radius of curvature 178 extend along the bottom in non-interfering relationship with belts 174. A plurality of individual guide or pressure rollers 180 are mounted on plates 176 onto engage belts 174 as they begin to contact rollers 164. In like manner, a series of rollers 184 also mounted on plates 176 engage the belts 174 to assist in the positive movement of sheets of paper around the lower end of the intermediate conveyor as the belts leave contact with rollers 164. In this way, paper sheets move positively around the end of the intermediate conveyor to be engaged by the feed conveyor 28 to be described hereinafter.

In like manner, upper intermediate conveyor 24 has larger diameter upper belt pulleys 190 mounted on shaft 192 with pressure or paper guide rollers 194 and 196. Lower end pulleys 198 are mounted on shaft 200 with the upper end shaft 192 and the lower end shaft 200 being mounted at the ends of plenum wall 202 having transverse and longitudinal rows of openings 204. Belts 206 extend around the upper and lower pulleys again with idler or wrap-around pulley assembly 208 serving the same function as pulleys 172 at the lower end of the lower intermediate conveyor. Finally, guide plates 210 having a radius of curvature 212 allow a sheet of paper to traverse around the top end of the conveyor to the vertical feed conveyor. It is to be observed that the pressure or retainer rollers 196 and 194 could be mounted individually on the guide plates or on a common shaft or bar extending laterally across the top.

Figure 9:
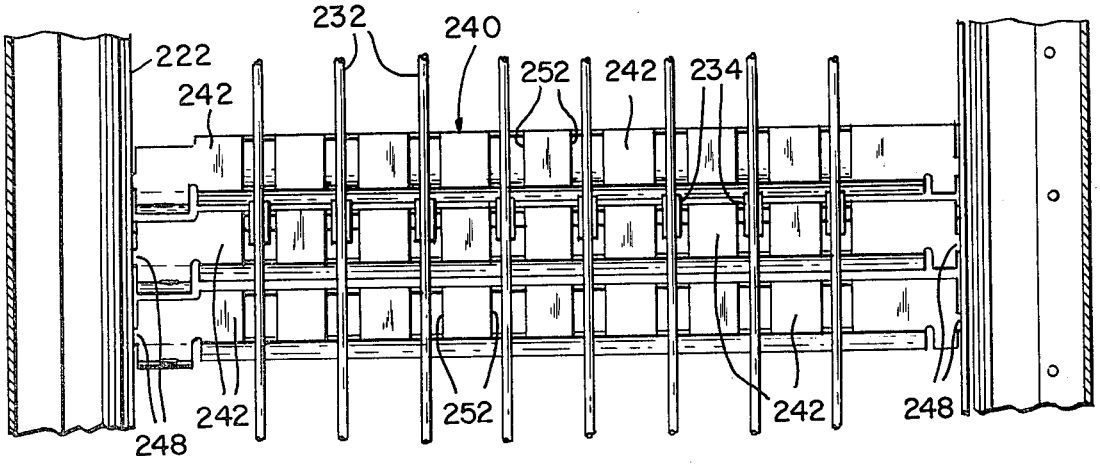
FIG. 9 is a partial elevational cross-sectional view along the line 9—9 of FIG. 8 showing additional conveyor details.
Figure 10:
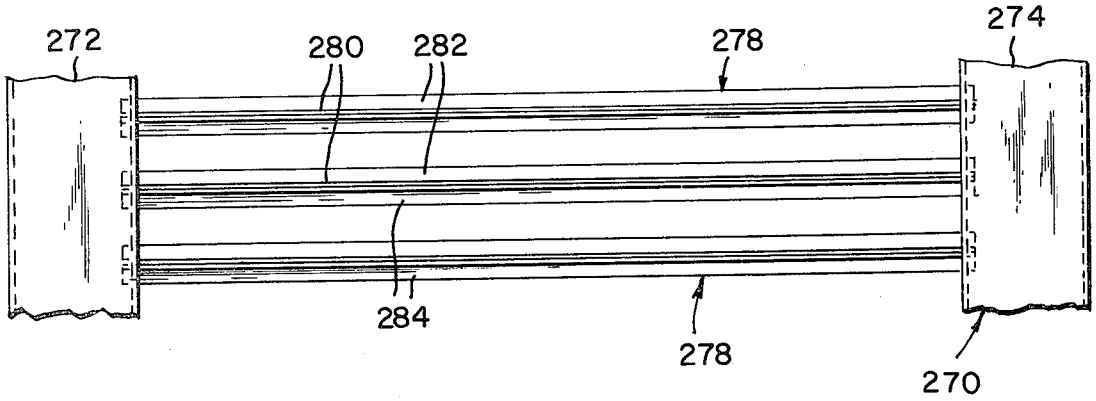
FIG. 10 is a partial front elevation view of the deflector guide section of the feeder.

The feeder conveyor section 28, reference being had to FIGS. 4 and 8 through 12, has side frame members 220 and 222 which attach to and extend between the vertical mounting pieces 129 and 130 as seen in FIG. 8. At the upper end of feeder conveyor 28 are belt pulleys 224 mounted on shaft 226 and at the lower end are pulleys 228 mounted on shaft 230. A series of belts 232 extend around the upper and lower pulleys 224 and 228 and idler or guide roller assembly with pulleys 234 are mounted at spaced intervals between the upper and lower end pulley assemblies as seen in FIGS. 8 and 9.

A series of deflectors numbering 51 in total are spaced between the frame members 220 and 222, said deflectors being generally designated by the number 240. The deflectors 240 are elongated members of light aluminum sheet having a front surface 242 and at approximately 90° or at a right angle thereto a backwardly extending top surface 244 and the two walls form an edge 243. At each end of the deflector is an extension portion 246 with a mounting tab piece 248 located at the outermost lower part of the extension section 246. The tabs 248 mount in the triangular openings 250 in the side mounting pieces 220 and 222. It can be seen that the deflectors are formed with a series of cutout sections 252 which are formed in the face wall 242 and the top wall 244. Diagonal portions 254 extend from the lower part of the face wall 242 to the rear part of the upper wall 244 within the cutout sections 252 although diagonals 254 may be eliminated altogether. The openings 252 are formed in the deflector to provide clearance for the belts 232 when the deflector is moved out to its paper intercept position. A rear wall 256 extends from the lower part of the front face wall 242 generally rearwardly along substantially the entire length of the deflector to provide a strengthening continuous wall section for the deflector. A rearwardly and downwardly angling top connector wall 258 also extends from the rear part of top wall 244 for the same strengthening features. At one end section 246 of the deflector is a depending actuator leg 260 which as can be seen is connected to one end of a compression spring 262. The deflector is biased by the spring 262 into its retracted mode by pushing against the leg 260 to rotate the deflector rearwardly. Each spring 262 connects to the core member of a solenoid 264 so that when the solenoid is actuated the spring 262 is compressed to pull tab 260 in to force the deflectors to rotate outwardly into the position shown best by the second deflector in FIGS. 4 and 11.

FIGS. 4, 8, 10 and 11 show details of the deflector guide assembly generally designated by the number 270 which includes side frame members 272 and 274 with one side 274 being provided with a hinge 276 for swinging the deflector guide assembly away from the face of the feed conveyor. Extending horizontally between the side frame members 272 and 274 are the generally Y-shaped guide deflectors indicated by the number 278. The guide deflectors have a horizontal outer section 280 terminating at an outer end 281 and an upwardly angled inner arm 282 and a downwardly angled inner arm 284. It will be noted by reference to FIGS. 4 and 11 that the outer end 281 of the horizontal section 280 of the deflector guides terminates approximately mid-way between the openings to bins in the receiver. When the deflectors 240 are rotated or pivoted outwardly to intercept a piece of paper the edge 243 is approximately midway between the lower angled arm 284 and the upper angled arm 282 of adjacent deflector guides. Thus a sheet of paper coming from the top of the feeder conveyor will be deflected into a given bin address by one deflector and if approaching its bin address from the bottom of the feed conveyor will be deflected into the same address by the next lower deflector. Since there are 50 bins in the receiver and 50 guide deflectors 278 it is necessary that there be 51 deflectors in order to properly address sheets of paper into the available bins. An opening 286 is formed in each guide 278 and extends all the way from the top to the bottom of the deflector guide assembly 270 to accommodate the light and photocell components 283 and 285 as seen at the bottom and top of the feeder conveyor tower in FIG. 4.

Figure 11:
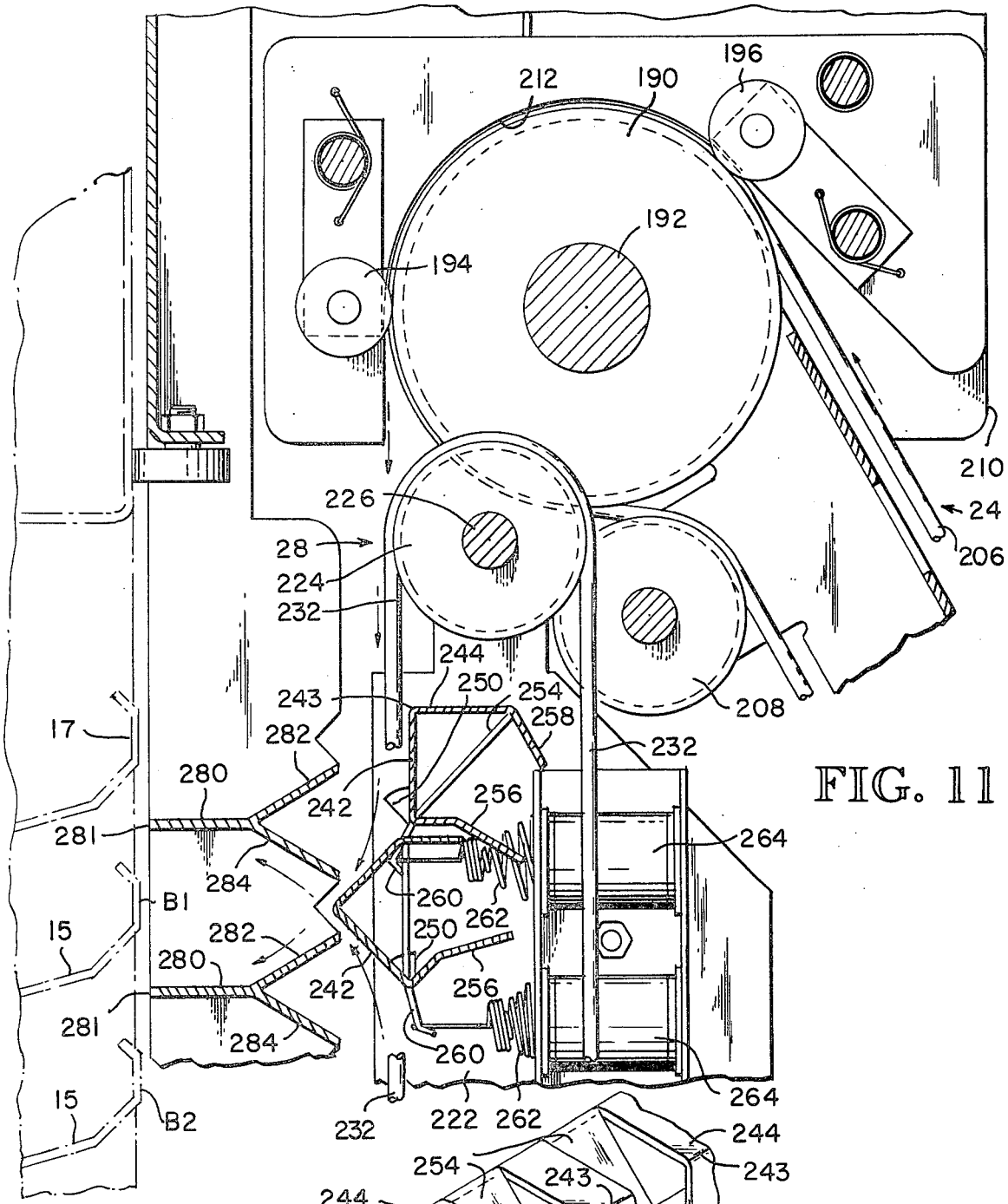
FIG. 11 is an enlarged partial cross-section view in elevation showing in greater detail the construction features of the invention.
Figure 12:
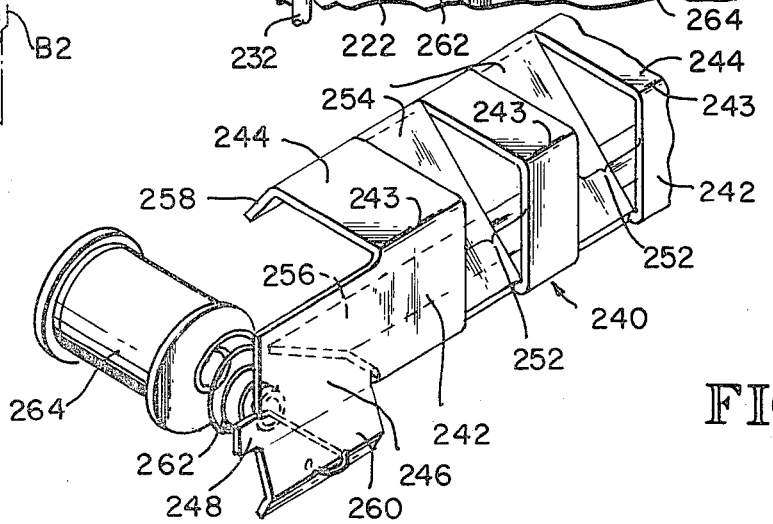
FIG. 12 is a partial view in perspective showing additional details of the deflector.

Receiver 14 has fifty functioning bins 15 as seen in FIGS. 4 and 11. The top bin 17 is a nonfunctioning bin because it will be observed that the topmost deflector guide 278 is located below the nonfunctioning bin 17 and above the topmost of the fifty functioning bins 15. By reference to FIG. 11, it will be seen that a sheet of paper coming down the conveyor is directed into bin B1 by the topmost deflector 240 being energized into its deflect or intercept position. In order to direct a sheet of paper into bin B1 coming up the conveyor it is necessary that the next lower deflector 240 be actuated. The sorter control system is programmed so that the proper deflector is actuated in order that a specific bin address receive a paper sheet. Because it takes two deflectors to service one bin, it will be appreciated that the conveyor requires 51 deflectors with 50 deflector guides 278 to service 50 functioning bins 15. By referring to the deflectors and particularly the actuated deflector, it is understood that it services two bins 15 depending on the direction of travel of the paper sheets.

A clutching and drive assembly is shown diagrammatically in FIG. 7 and includes motor 110 and a drive pulley 111. The drive pulley drives belt 113 which in turn drives pulley 115 on shaft 166 at the bottom of lower intermediate conveyor assembly 26. Note in FIG. 6 that a belt 98, also seen in FIG. 2, is used to transfer power from the lower intermediate conveyor 26 to the upper intermediate conveyor 24 and also to the infeed conveyor 18. A belt 92 at the outer end of the infeed conveyor drives the proof conveyor belts. Thus it will be seen that the motor 110 drives all of the conveyor sections of the feeder. In order to reversibly drive feeder conveyor belts 232, two clutch assemblies 117 and 119 are driven by a belt 121 through a lower pulley 123 and an upper pulley 125. A reversing drive belt 127 connects drive power to lower shaft 230 of the reversible feed conveyor through pulley 231. When clutch 117 is engaged, the feeder conveyor is moved to transport paper upwardly from the bottom. When the lower clutch 119 is engaged, the feeder conveyor will transport paper from the top down. It will be seen by reference to FIG. 4 that a horizontally disposed contact roller 290 near the top and a horizontal roller 292 near the bottom are supported on the feeder to engage the receiver 14 as it moves laterally by the feeder to prevent contact and to maintain a predetermined distance relationship between receiver and feeder.

Figure 13:
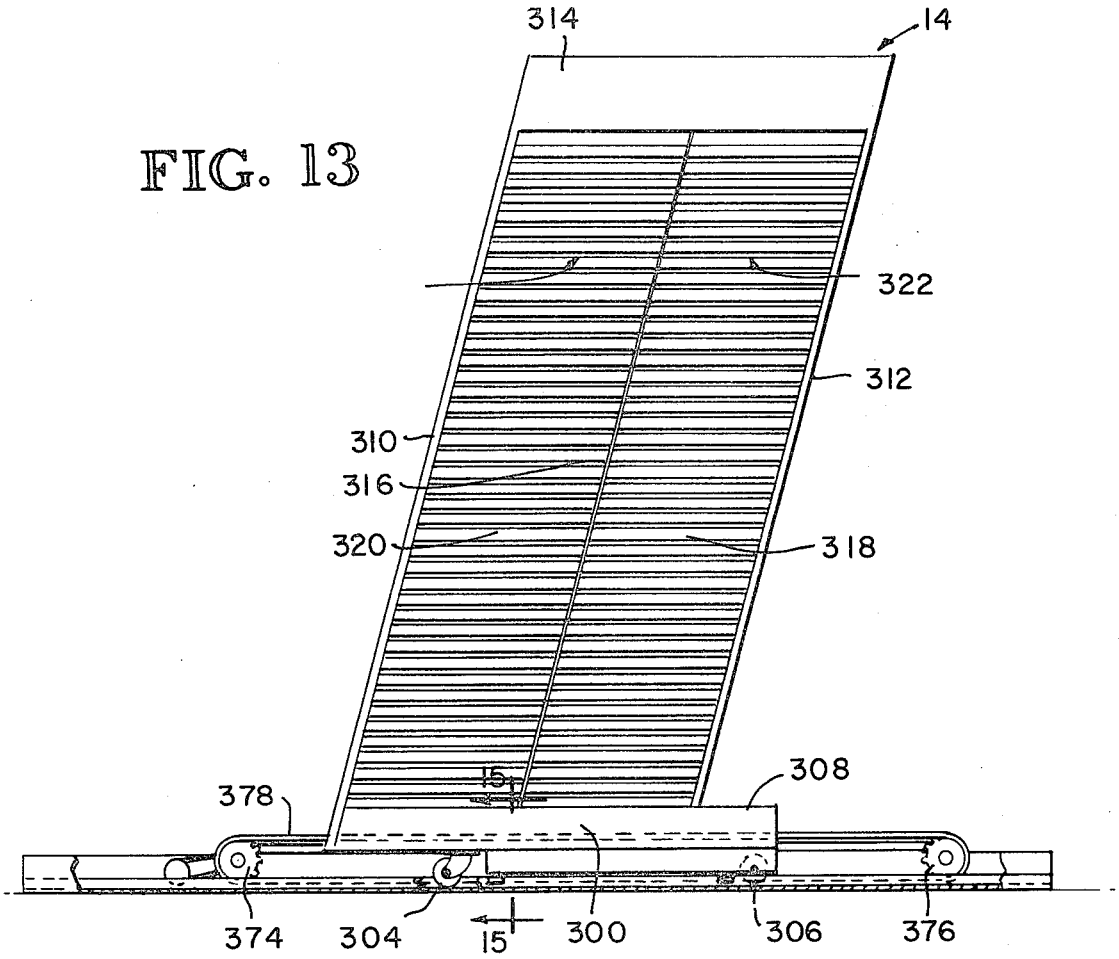
FIG. 13 is a front elevation view of the receiver of this invention.

It will be seen by reference to FIG. 13 that the receiver 14 is comprised of a base section 300 having a bottom wall 302, and casters 304 and 306 with the casters 306 being located under the extension section 308 of the base 300. Upwardly extending side frame members 310 and 312 are interconnected at their upper end by frame top section 134. A center frame piece 316 divides the receiver into two angled columnar spaces 318 and 320. The columnar spaces 318 and 320 include individual shelves or bins 322 which will be described more in detail hereinafter. The generally upstanding receiver structure has an entrance side 324 and an unloading or exit side 326. The frame is generally vertical in the plane of its entrance and exit sides and inclines at a predetermined angle in the direction of its movement.

Figure 15:
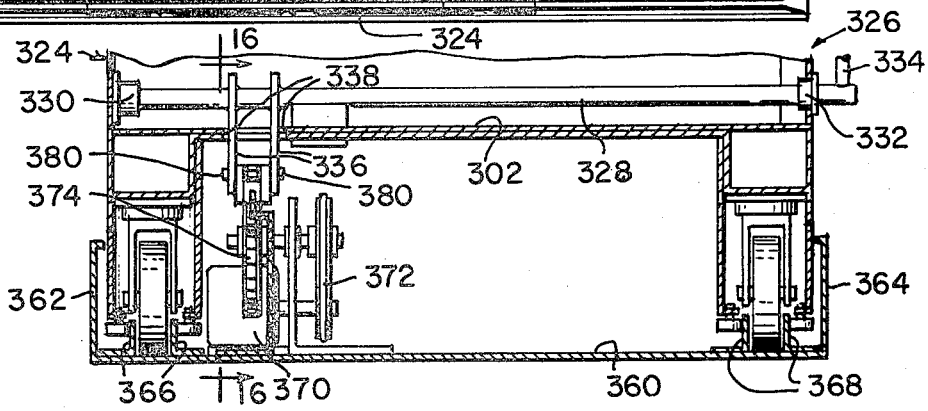
FIG. 15 is a partial elevational cross-section view of the receiver base and track assembly.
Figure 16:
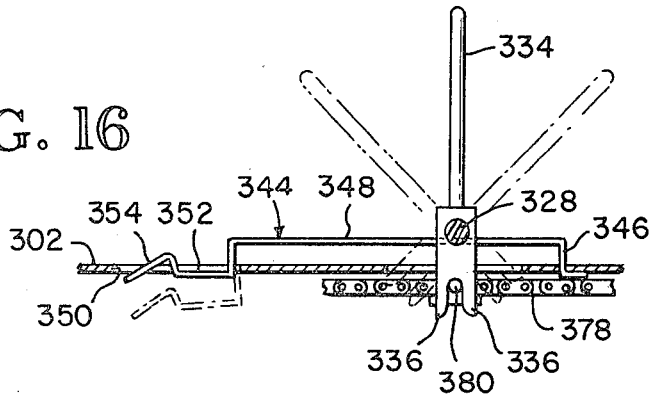
FIG. 16 is a partial elevational cross-section view showing details of the chain engagement means and the module interlock.
Figure 17:
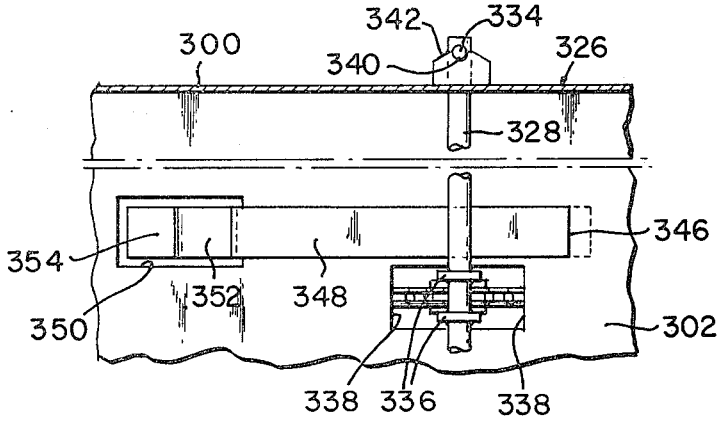
FIG. 17 is a partial plan view of the details of FIG. 16.

Extending across the depth of the machine from the entrance to the unloading side, as best seen in FIGS. 15, 16 and 17, is an actuator rod 328 which is spaced just above bottom wall 302 and which rod 328 is supported by bearing 330 at one end and bearing 332 on the exit side of the machine. Rod 328 can be seen to extend through the base wall 300 to the exit side and on the opposite is provided with a handle 334, which extends generally upwardly for easy access by the operator.

Secured to rod 328 are a pair of depending engagement forks 336 which extend through an opening 338 in bottom wall 302. As can be seen, the forks 336 are spaced apart so that they will not interfere with the receiver chain drive on the support and drive track. Handle 334 of the engagement rod 328 engages a notch 340 in a holding clip 342 secured to the center frame piece 316 on the unloading side. It will be noted that the handle 334 engages retainer notch 340 in the generally perpendicular position and in which position the forks 336 extend generally straight down. A spring latch member 344 is supported at its anchor end 346 by wall 302. The spring latch member has a generally horizontal section 348 which extends under rod 328 and towards that end of the base away from extension platform 308. An opening 350 is provided in base wall 302 to receive a coupler section 352 and ramp 354 formed in the other end of the spring latch 344. When handle 334 is in the vertical position, as shown in FIG. 16, spring latch 344 with the coupler section 352 is up as shown so that if a second modular receiver unit 14 is being used the two units will be latched together. A flat is formed in rod 328 to register with the latch when the forks are engaged with the chain. An opening is located in extension section 308 which will slide up ramp 354 and under the opposite end of the base and will register with the opening 350. When the forks on rod 336 are straight down and thus engaged with the chain, as mentioned above, spring latch 344 is up and the coupler section 352 extends through the opening 350 in the base wall 302 as well as through the opening in the extension section 308 of the second receiver module thus holding the two receivers together. It will be noticed that the handle 334 is moved according to the direction which it is desired to roll the receiver. When handle 334 is moved the flat is rotated with the rod to cam the latch down and release the receiver modules from each other. If an empty receiver is being rolled onto the track section, the handle will be moved in one direction so as to present the forks 336 at an appropriate angle. If it is desired to roll the receiver off after it is filled, then the handle 328 is moved in the opposite direction to permit forks 336 to release from the chain mechanism.

Figure 14:
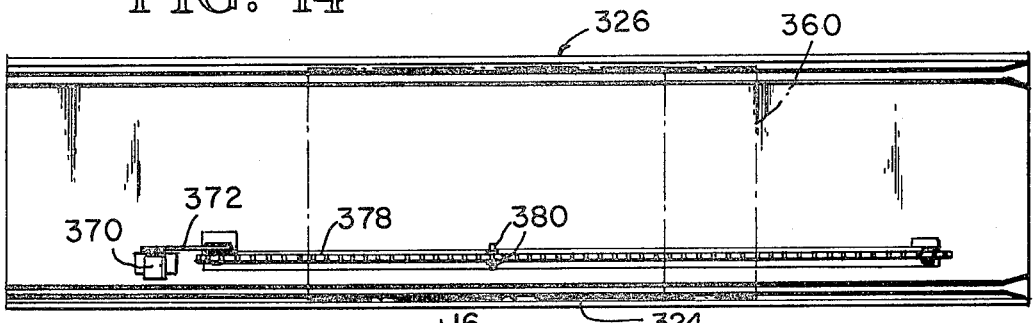
FIG. 14 is a partial top plan view of the track assembly showing details of the track construction.

The track section 16 includes a floor wall 360 with upstanding side channel 362 on the entrance side and upstanding channel 364 on the exit side. Supported on the floor wall 360 of the track section 16 are caster guide walls 366 for casters 304 and 306 and track guide walls 368 near side rail 364 for receiving the other casters 304 and 306. The guide rails 366 and 368 can be seen in FIG. 14 to be spread slightly at the incoming end of the track to facilitate rolling an empty unit onto the track.

Between the guide rail channels for the casters is a drive motor 370 which through drive chain 372 turns a reduction gear which in turn drives a main chain pulley 374. An idler chain pulley 376 is located at the other end of the track section so that a continuous drive chain 378 extends around the chain pulleys 374 and 376. Secured to the chain as can be seen in FIGS. 15, 16 and 17, is a transverse arm member 380 which is mounted on the chain such that it extends out on either side to be engaged by forks 336. When a new receiver has been rolled onto the track section, the handle 334 which controls the position of the engaging forks 336 is moved so that the forks are angled to allow the forks to engage member 380. As soon as engagement has been made, the bar is moved to the upright position to firmly secure the receiver to the chain. The controls will then by appropriate energizing signals to motor 370 position the receiver with respect to the feeder to present a particular bin address such as bin number B1 in proper position for beginning a sorting operation.

Figure 18:
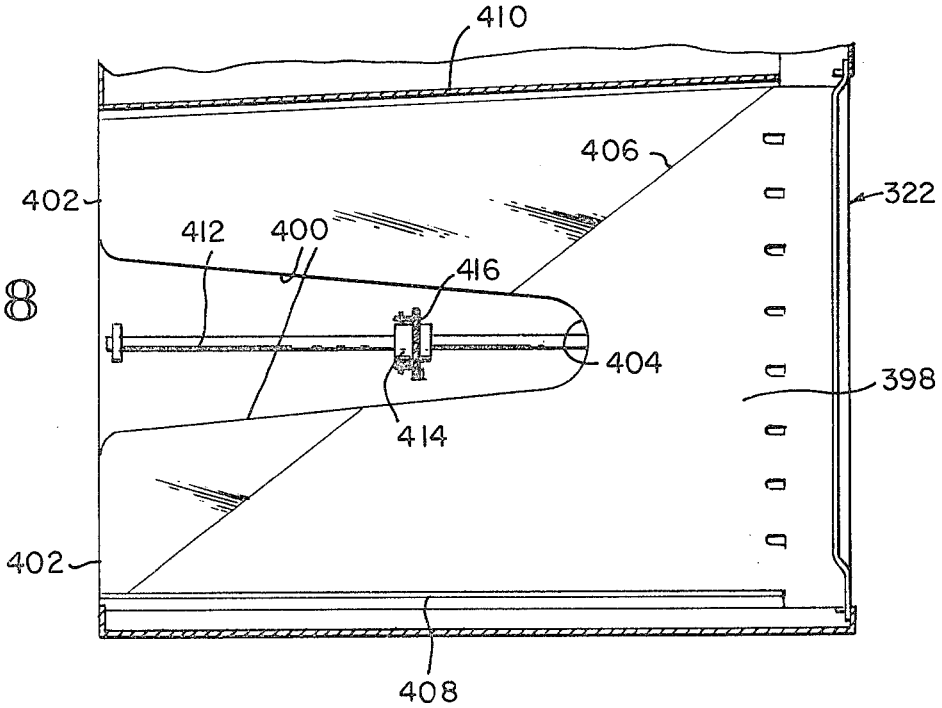
FIG. 18 is a partial plan view of a bin in the receiver.

The bins, best shown in FIGS. 18 through 20, and generally identified by the number 322, have a generally upstanding entrance wall 390 which has an upper edge 392 which as can be seen is spaced a predetermined distance below the bin next above. The deflector guides 278 are part of the feeder and are in approximately the position shown in FIG. 20, when the sorter is in operation. Thus, the entrance wall 390 is angled as at 394 and 396 to facilitate the entrance of sheets of paper which will be entering a bin either from above or from below depending upon whether the feeder is sending sheets over the top or around the bottom. The bins 322 have main support wall or shelf portion 398 which also can be best be seen in FIG. 18 to have a center cut-away portion 400 which extends from the exit of unloading end 402 generally centrally thereof to an inner end 404 which as can be seen is a slightly more than half-way toward the entrance end of the bin. The bins 322 are formed such that the shelf portion 398 is generally horizontal across the front.

Extending diagonally from one side of the front to the opposite side at the unloading end is a line 406 which places the approximate other half of the shelf portion 398 at a slight downward angle to assist in moving paper into lined stacks in the bin. A side wall 408 is formed along the high side of the bin and on the opposite side is wall 410 along that side of the bin having the angled down section. At the top and bottom of the sorter frame structure are two support rods 412, only one of which is shown in FIG. 18, which support releasable slide pieces 414. A belt member 416 attaches to the pieces 414 and extends through the cut-out portion 400 of the stack of bins to arrest the motion of the sheets of paper after they enter the bins. The belt 416 is not a jogging device since the slanting of the bin shelves is the primary factor in the alignment of the sheets of paper into neat stacks.

FIG. 21 indicates diagrammatically more detail about the arrangement of the bins. The bins are arranged so that in a column the bin next below the bin next above is spaced laterally a specified amount as for instance 0.30 or 0.242 inches depending upon the width of the bins in the particular receiving being used. The increment of distance by which the bins are laterally offset from each other is consistent down the entire length of the column from B1 to B50. In like manner, the top bin B51 in the second column is spaced the same amount of distance laterally from B50 as the rest of the bins are from each other. The controls are set to index the motor or movement of the chain to present a particular bin dress from B1 through B100 to a delivery position adjacent the feeder 14.

Operation of the feeder and receiver is continuous and is best described as follows. A first or page "1" master is inserted in the press or duplicator. Several copies are first directed to the proof tray and then the sorting job begins. Odd numbered pages coming out of the press are directed to lower intermediate conveyor 26 and up the feeder conveyor to the top bin. Sheets will be fed up the conveyor 232 and deflected to the desired bin address by a deflector and the lower surface of a Y-shaped deflector. The receiver moves a discrete distance from left to right and presents the next bin address until all 50 bins in a column have been filled. If the sorting job extends to the next column copies continue to be fed to the feeder conveyor via lower intermediate conveyor 26 and up the feeder conveyor to the topmost bin in the second column. The topmost bin of the second column is offset from the lowermost bin of the first column by the same increment of distance as the bins are offset from each other in each column. Assuming that two complete columns of bins are being used for a sorting job, the feeder continues to feed around the lower intermediate conveyor until all fifty bins in the second column are filled. By the time the bottom-most bin in the second column has received its copy of page 1 from the press, copies of the page 2 master are already proceeding up the upper intermediate conveyor 26. The feeder belts 232 are reversed to bring the first sheet from the top to the bottom of the feeder conveyor and filling of the bins with copies of page 2 begins with the lowest bin in column 2 where the first page sorting job ended. Thus the feeding of bins is continuous not only from bin to bin but from column to column. Also, it can be appreciated that odd numbered pages from the duplicator are fed from the bottom up while the receiver indexes from left to right and even numbered pages are fed from the top down while the receiver moves from right to left. Obviously, also, two adjacent deflectors are needed for a single bin address. When coming down the conveyor sheets are deflected by the top one of two adjacent deflectors and directed against the top surface of a deflector guide and into the bin opening. When coming from the bottom the sheet is deflected by the lower one of two adjacent deflectors and off the lower surface of a deflector into the same bin address. Thus the need for one more deflector than there are bins or guides.

What is claimed is:

1. A continuous paper sorter mechanism, comprising:

(a) a receiver section having a support frame including a base section with caster means attached to the bottom of said base for movement of said receiver along a track assembly and further including upstanding support frame means for supporting a predetermined equal number of paper receiving bin means in side-by-side columns in such a way that said columns are canted at a preselected angle in the direction of movement of said receiver and which frame means has an entrance side and an unloading side and which sides are adapted to be generally parallel to a feed conveyor, (b) an elongated floor track assembly for supporting said receiver mechanism thereon, and including drive means for moving said receiver in both directions along a predetermined path on said track assembly, (c) a generally upright continuous feeder mechanism including (1) a main supporting frame including a base section and an upstanding tower section, (2) a first infeed conveyor means for receiving sheets of paper to be sorted from a paper copy-making device and having a receiving end and a discharge end, said first conveyor means including directional deflector means at its discharge end for selectively directing sheets of paper to a second or third intermediate conveyor means, (3) a second intermediate conveyor means for receiving paper sheets from said first conveyor means for transporting sheets of paper to the upper end of a feeder conveyor means, (4) a third intermediate conveyor means for transporting sheets of paper to the lower end of a feeder conveyor means, (5) generally vertically disposed fourth feeder conveyor means in predetermined spaced relation to the entrance side of said receiver section and which is reversible so as to selectively receive paper sheets from said second and third conveyor means, said fourth feeder conveyor also including a plurality of bin deflector means for selectively directing paper sheets into said bin means as the said paper sheets proceed along said fourth feeder conveyor means either from the top or from the bottom, and (d) means for moving all said conveyor means, means for selectively reversing said fourth feeder conveyor means, and means for selectively actuating all said deflector means.

2. The continuous sorter mechanism according to claim 1 and in which a plurality of paper deflector guide means are provided generally between said bin deflector means and the entrances to said bin means for assisting in directing sheets of paper to said bin means.

3. The continuous sorter mechanism according to claim 2 and in which said plurality of paper guide means are mounted on a secondary frame pivotally attached to said tower section so that said paper guide means may be swung away from said fourth feeder conveyor means and said bin deflector means.

4. The continuous sorter mechanism according to claim 2 and in which said bin means have entrance openings and in which the deflector guide means for each bin means opening has a horizontal section terminating in predetermined spaced relationship to the plane of the receiver bin means entrances and positioned so as to be generally midway of the vertical dimension of said bin means entrance opening.

5. The continuous sorter mechanism according to claim 2 and in which said deflector guide means are mounted in a hinged frame connected to said feeder.

6. The continuous sorter mechanism according to claim 1 and in which said intermediate second and third conveyor means angle upwardly to the upper end and downwardly to the lower end respectively of said fourth feeder conveyor means.

7. The continuous sorter mechanism according to claim 1 and in which a drive and clutching means are located in the base section of said main supporting frame for effecting rapid reversal of said fourth feeder conveyor means.

8. The continuous sorter mechanism according to claim 1 and in which a proof or paper receiving tray is located above said first infeed conveyor means for selectively receiving sheets of paper from said first infeed conveyor means, and further including a proof deflector means near the receiving end thereof for selectively guiding sheets of paper off said infeed conveyor means and to said proof tray.

9. The continuous sorter mechanism according to claim 8 and in which said fifth proof conveyor means is disposed generally between said proof deflector means and said proof tray for conveying sheets of paper to said proof tray.

10. The continuous sorter mechanism according to claim 1 and in which all of said conveyor means are comprised of a plurality of generally equally spaced apart, minimum area cross-section, individual continuous belt strips which present a minimum amount of contact with said sheets of paper to reduce the driven conveyor mass and to reduce the static electricity charge in the paper sheets and conveyor system, said individual belt strips being mounted on drive and idler rollers to minimize friction in the conveyor system.

11. The continuous sorter mechanism according to claim 1 and in which air evacuating means are provided for creating a vacuum for all of said conveyor means for assisting in the transport of sheets of paper on all said first, second, third and fourth conveyor means.

12. The continuous sorter mechanism according to claim 1 and in which said plurality of bin deflector means are provided with individual solenoid means for selectively actuating each bin deflector means as determined by the control system.

13. The continuous sorter mechanism according to claim 1 and in which each bin deflector means is spring loaded to a normally retracted position and also connected to an electrical actuator device for being pivoted to its deflect position.

14. The continuous sorter mechanism according to claim 1 and in which said track assembly further includes chain drive means for moving said receiver along guide channel means on said track assembly, said chain drive means including a holding member for releasably engaging a drive engaging member on said receiver base to position said receiver at a preselected position with respect to said chain drive means, and power means for driving said chain.

15. The continuous sorter mechanism according to claim 14 and in which said holding member is a transversely disposed arm member secured to the upper run of said chain drive means and in which said releasable drive engaging means is a pivotal fork member for releasably engaging said arm member for precise positioning of said receiver on said track.

16. The continuous sorter mechanism according to claim 15 and in which said pivotal fork member is secured to an actuator bar having an operator handle which releasably locks the bar and fork member into operative engagement with said arm member for positioning of said receiver, and which actuator bar and operator handle can be moved so as to disengage said fork member from said arm member to allow the receiver to be rolled onto or off said floor track assembly.

17. The continuous sorter mechanism according to claim 1 and in which each column contains 50 bins such that numerically corresponding bin means are horizontally aligned to their entrance ends.

18. The continuous sorter mechanism according to claim 17 and in which each bin means has a generally upstanding entrance wall extending upwardly to within a preselected distance of the bin means next above it to define said entrance opening.

19. The continuous sorter mechanism according to claim 1 and in which at least a portion of each of said bin means tilts downwardly to assist in the alignment of paper copies into neat stacks.

20. The continuous sorter mechanism according to claim 19 and in which said bin means are provided with cutaway sections extending from the unloading end toward the entrance end such that an unobstructed cavity is defined from the base to the top of said receiver frame through each column of bin means and through which cavity paper arresting means extend.

21. The continuous sorter mechanism according to claim 1 and in which said base of said receiver extends generally horizontally in the direction in which the bin means columns are angled to form a base extension and under which extension is located said caster means.

* * * * *